US006561867B1

(12) United States Patent
Rehkemper et al.

(10) Patent No.: US 6,561,867 B1
(45) Date of Patent: May 13, 2003

(54) YO-YO HAVING A CENTERED DISC SUPPORTED BY AN ARM

(75) Inventors: Steven Rehkemper, Chicago, IL (US); Keith Johnson, Des Plaines, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 10/233,210

(22) Filed: Sep. 3, 2002

(51) Int. Cl.[7] ..... A63H 1/30
(52) U.S. Cl. ..... 446/247; 446/396
(58) Field of Search ..... 446/236, 247, 446/248, 250, 251, 396

(56) References Cited

U.S. PATENT DOCUMENTS 833,610 A * 10/1906 Liebreich et al. ..... 446/250
5,961,366 A * 10/1999 Wei ..... 446/250
6,196,891 B1 * 3/2001 Jamison ..... 446/250

* cited by examiner

*Primary Examiner*—Jacob K. Ackun

(57) ABSTRACT

A yo-yo includes an outer ring, a support arm extending inwardly from the outer ring and a disc supported within the outer ring by the support arm. In addition, a region on the outer ring adjacent the support arm is thinner then another region on the outer ring opposite the support arm to compensate for any additional weight defined by the support arm. Furthermore, the outer ring is defined as having a cavity and the disc has an overall shape smaller then the cavity such that the disc appears to be suspended within the outer ring.

13 Claims, 2 Drawing Sheets

YO-YO HAVING A CENTERED DISC SUPPORTED BY AN ARM

CROSS-REFERENCE TO RELATED APPLICATIONS

This application claims the benefit of U.S. Design patent applications having Ser. No. 29/164,620 and filed on Jul. 29, 2002 and hereby incorporates the design application by reference.

FIELD OF THE INVENTION

The particular invention relates to yo-yos and more particularly to yo-yos that include new and novel features that redistributes the weight of the yo-yo such that the most of the weight is distributed about the perimeter of the yo-yo.

BACKGROUND OF THE INVENTION

Yo-Yos have been around for many years and are enjoyed by both children and adults. There are numerous varieties of yo-yos from a simple wood design construction to a yo-yo watch, such as U.S. Pat. No. D443,530. There exist yo-yos that glow in the dark and yo-yos with visual display and feedback, such as U.S. Pat. No. 6,287,193, co-owned by the assignee of the invention.

A typical yo-yo includes two halves that are secured to each other about an axle, also the center of rotation. When assembled, the outer portion of the yo-yo is rounded and solid such that a user may adequately grip and roll the yo-yo into and out of their hand. In order to connect the outer portion to the center of rotation, each halve typically includes an integral side body portion or plate that connects the center of rotation to the outer portion.

It is a well known fact that a spinning yo-yo has similarly characteristics as a flywheel, meaning the distribution of the mass of the yo-yo has a direct effect on the efficiency of the yo-yo. While theoretically a perfect flywheel contains all of its mass around the perimeter, conventional yo-yos as mentioned above employ side body portions or plates to attach the outer ring to the center axle. This side body portion or plate increases the mass throughout the body of the yo-yo, thus decreasing the efficiency of the yo-yo. As such there is a need for a new and novel yo-yo that maximizes the performance of the yo-yo by maximizing the weight around the perimeter, thereby increasing the efficiency of the yo-yo, when compared to conventional yo-yos.

SUMMARY OF THE INVENTION

In accordance with the present invention a yo-yo is provided that includes a centered disc that is supported within an outer ring by a support arm. The support arm extends inwardly from the outer ring. The yo-yo is also balanced to compensate for the extra weight of the support arm so that the centrifugal forces are substantially equal throughout the outer ring. The compensation is accomplished by having a continuously tapering wall thickness from the area adjacent the support arm to an area directly opposite the support arm.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
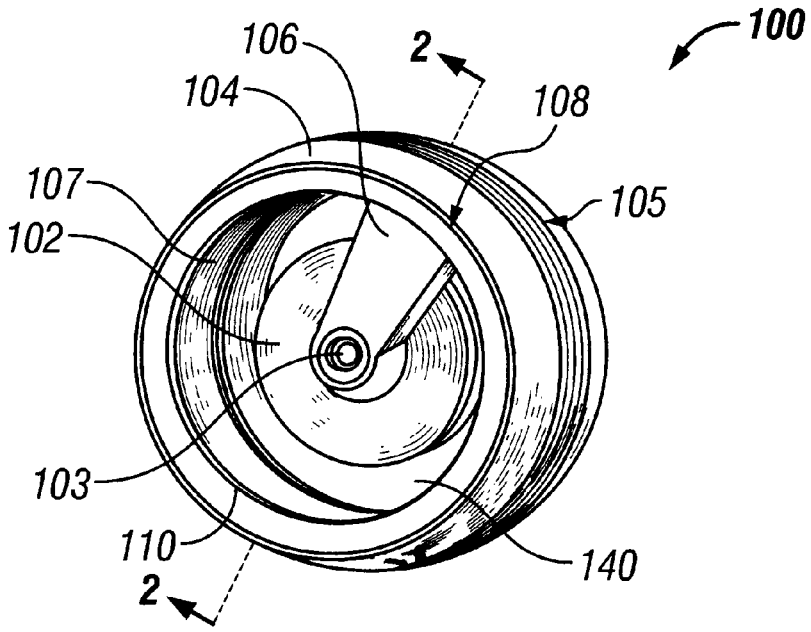
FIG. 1 is a perspective view of a yo-yo having an inner disc supported by a single support arm.
Figure 2:
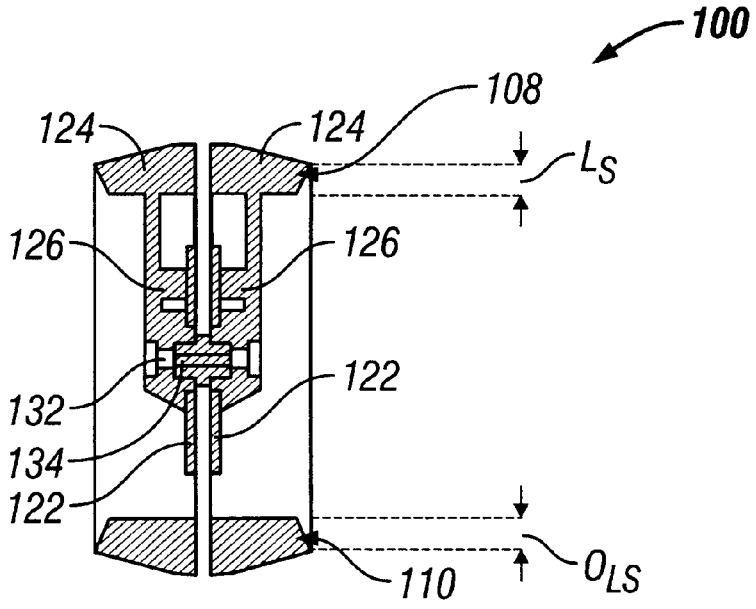
FIG. 2 is a cross-section view along section line A—A of FIG. 1.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, there is shown a yo-yo in accordance with the present invention, generally referenced herein as 100. The yo-yo includes an outer ring 104 that has an exterior surface 105 that is preferably rounded such that a user may adequately grip and roll the yo-yo into and out of his/her hand. To maximize the weight of the yo-yo 100 about the perimeter of the yo-yo 100, the outer ring 104 has a cavity 140; as if the side plate on a typical yo-yo has been removed. To connect the outer ring 104 to the center of rotation 103 of the yo-yo 100, a support arm 106 extends inwardly from a region 108 defined on the outer ring 104 to the center of rotation. To support the string (not shown) when the yo-yo 100 is winding and to prevent the string from winding around or bunching up around the support arm 106, a disc 102 is positioned about the center of rotation 103, between the string and the support arm 106. The disc 102 preferably has a diameter or overall shape that is smaller than the cavity 140 of the outer ring 104 such that the disc 102 appears to be suspended within the cavity of the outer ring 104. The disc 102 also preferably is extremely thin such that hardly any weight is added to the yo-yo, keeping the distribution of weight primarily around the perimeter or outer ring 104.

In a typical yo-yo opposing regions cut from a single plane are identical in shape and weight so the centrifugal forces are substantially equal throughout the yo-yo, this provides a balanced yo-yo that has an even rotation. However, since the support arm 106 in the present invention adds weight to a region 108 on the yo-yo 100 (referred to herein as "support region 108"), the support region 108 would be heavier then a region 110 on the same plane that is directly opposite the support arm 106 (referred to herein as "opposing region 110"). To balance the yo-yo and compensate for this weight differential the thickness of the outer ring 104 at the support region 108, defined as a support length $L_s$ is thinner then the thickness of the outer ring 104 at the opposing region 110, defined as a opposite length $OL_s$. The change in thickness from the support region 108 to the opposing region is preferably a tapering wall thickness, such that the change is unnecessarily dramatic. Since, as mentioned above, the exterior surface 105 of the outer ring 104 is rounded to provide a user with a smooth feeling when using the yo-yo, the change in thickness is taken from the interior surface 107 of the outer ring 104. Alternatively, it is within the scope of the invention that the opposing region 110 could alternatively be provided with extra weight that would similarly counter the weight difference.

Figure 3:
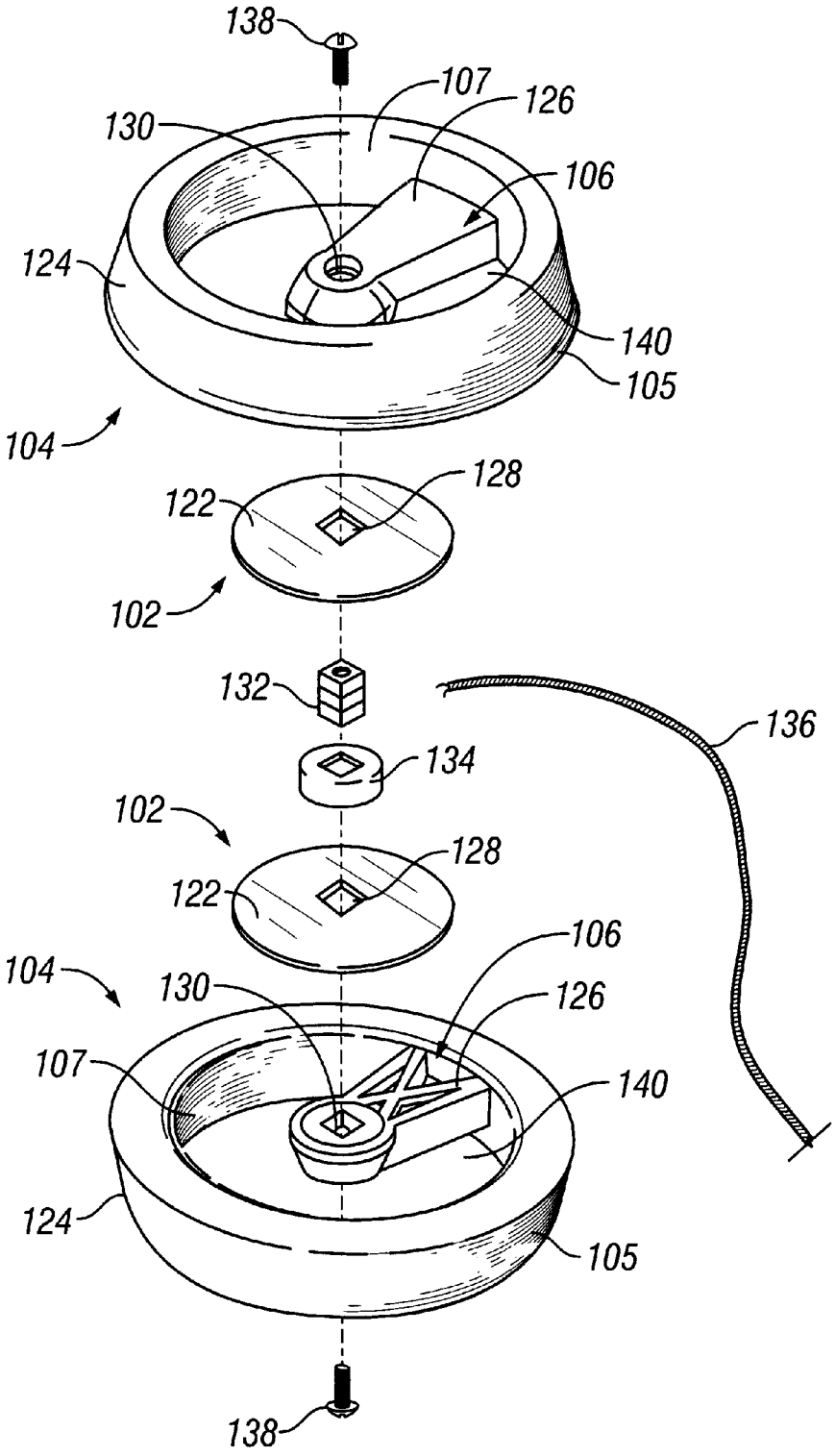
FIG. 3 is an exploded view of the yo-yo from FIG. 1.

Referring now to FIG. 3, the yo-yo 100 is constructed by splitting the yo-yo 100 into two halves, as such the disc 102, outer ring 104, and support arm 106 are formed by the joining two disc halves 122, two outer-ring halves 124, and two support-arm halves 126, respectively. The support-arm halves 126 are preferably integrally formed into the two outer-ring halves 124. However, the support-arm halves 126 may also be attached to the outer-ring halves 124 by well known attachment means. The disc halves 122 and the support-arm halves 126 each include a bore 128 and 130, respectively, which is sized to receive an axle 132. The axle 132 further supports a bearing 134 and string 136. When assembled, the outer-ring halves 124 are secured to the axle 132 separately by screws 138.

While the disc 102 is illustrated as being supported by one arm it is further contemplated that the size, shape and length of the arm 106 may be changed, or multiple arms may extend inwardly from the outer ring 104. In such other circumstances the balance of the yo-yo may be maintained by changing the weight in adjacent regions 108/110 on the outer ring 104. For example, if the disc 102 were supported by a pair of opposing arms extending along the same plane, the balance of the yo-yo would be maintained because the two support arms would counter themselves. However, if the pair of arms where not opposing but extending along different planes, the regions on the outer ring about the support arms could be thinner than the regions opposite the support arms.

Still yet in other embodiments, the shape of the disc may include other polygonal sides, for instance the support arm may support or suspend starred or squared shaped objects. When the centered object is a polygonal it is still important to note that the overall dimensions and shape of the object should be less than the diameter of the cavity of the outer ring, such that the center object appears to be suspended within the cavity and to maximize the weight about the perimeter of the yo-yo. In addition it is also important to note, that preferably the object is symmetrical to maintain the overall balance of the yo-yo. However, it would still be contemplated by the present invention to employ a nonsymmetrical object as along as such regions in the outer ring were changed to compensate for any imbalance caused by the nonsymmetrical object.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A yo-yo comprising:

an outer ring that includes a cavity;

a support arm extending inwardly from said outer ring;

a disc supported within the cavity of the outer ring by said support arm; and a region on the outer ring adjacent the support arm is thinner then an opposing region on the outer ring opposite the support arm to compensate for the support arm such that centrifugal forces are substantially equal throughout said yo-yo.

2. The yo-yo of claim 1 wherein the disc has a shape smaller then the cavity of said outer ring.

3. The yo-yo of claim 2, wherein the disc is further supported by a second support arm extending inwardly from said outer ring adjacent a second region, and wherein said second region is thinner than an opposing region on the outer ring opposite the second support arm to compensate for the second support arm such that centrifugal forces are substantially equal throughout said yo-yo.

4. The yo-yo of claim 1, wherein the compensation for the support arm is further defined as the outer ring having a wall thickness that tapers from the region adjacent the support arm to the opposing region.

5. A yo-yo comprising a disc supported within an outer ring by a support arm, the support arm extends inwardly from said outer ring and a means to compensate for additional weight defined by the support arm such that the centrifugal forces are substantially equal throughout said yo-yo, wherein the compensating means is defined by having a region on the outer ring adjacent the support arm with a weight less then an opposing region on the outer ring positioned opposite the support arm.

6. The yo-yo of claim 5, wherein the outer ring includes a cavity and wherein the disc has a shape smaller then the cavity of said outer ring.

7. The yo-yo of claim 5 further comprising a plurality of support arms and a plurality of compensating means defined by having a region on the outer ring adjacent the support arm with a weight less then an opposing region on the outer ring positioned opposite the support arm.

8. The yo-yo of claim 7, wherein the compensating means is further defined by having thinner regions on the outer ring adjacent the plurality of support arms than regions on the outer ring opposing the plurality of support arms.

9. The yo-yo of claim 5, wherein the compensating means is further defined by having a wall thickness on the outer ring that tapers from the region adjacent the support arm to the opposing region.

10. A yo-yo comprising:

an outer ring having a cavity;

a support arm extending inwardly from said outer ring;

an object supported within the outer ring by said support arm, said object having a shape smaller then the cavity of the outer ring; and a region on the outer ring adjacent the support arm is thinner then an opposing region on the outer ring opposite the support arm to compensate for the support arm such that centrifugal forces are substantially equal throughout said yo-yo.

11. The yo-yo of claim 10, wherein the object has a symmetrical shape.

12. The yo-yo of claim 10, wherein the object is further supported by at least one more support arm extending inwardly from said outer ring, and wherein a region on the outer ring adjacent a support arm, of said at least one more support arm, is thinner than an opposing region to balance the yo-yo such that centrifugal forces on the outer ring are substantially equal throughout the yo-yo.

13. The yo-yo of claim 10, wherein the compensation for the support arm is further defined as the outer ring having a wall thickness that tapers from the region adjacent the support arm to the opposing region.

* * * * *